US010151561B1

(12) United States Patent
Bartak

(10) Patent No.: US 10,151,561 B1
(45) Date of Patent: Dec. 11, 2018

(54) ANTI-CANT INDICATOR

(71) Applicant: Tom Bartak, Bloomfield, NE (US)

(72) Inventor: Tom Bartak, Bloomfield, NE (US)

( * ) Notice: Subject to any disclaimer, the term of this patent is extended or adjusted under 35 U.S.C. 154(b) by 0 days.

(21) Appl. No.: 15/819,983

(22) Filed: Nov. 21, 2017

Related U.S. Application Data

(60) Provisional application No. 62/424,890, filed on Nov. 21, 2016.

(51) Int. Cl.
*F41G 1/44* (2006.01)
*F41G 1/38* (2006.01)
*F41G 11/00* (2006.01)

(52) U.S. Cl.
CPC ..... *F41G 1/44* (2013.01); *F41G 1/38* (2013.01); *F41G 11/003* (2013.01)

(58) Field of Classification Search
CPC ..... F41G 1/44; F41G 1/38
USPC ..... 42/120
See application file for complete search history.

(56) References Cited

U.S. PATENT DOCUMENTS 5,005,308 A * 4/1991 Parks ..... F41G 1/38 33/366.21
6,978,569 B2 * 12/2005 Williamson, IV ..... F41G 1/44 42/132
2016/0223293 A1 * 8/2016 Maryfield ..... F41G 11/00
2017/0138698 A1 * 5/2017 York ..... F41G 1/38

FOREIGN PATENT DOCUMENTS

EP 0497301 * 8/1992

* cited by examiner

*Primary Examiner* — Stephen Johnson
(74) *Attorney, Agent, or Firm* — Suiter Swantz pc llo

(57) ABSTRACT

A cant indication apparatus includes a spirit level having a first and second surface, said spirit level containing a first fluid, said first fluid having at least one of a first light transmittance and absorbance, and a second fluid forming a bubble in said first fluid, said second fluid having at least one of a second light transmittance and absorbance, said bubble position indicating orientation. The apparatus further includes a light receiving optical fiber having a light receiving end and a spirit level connection end, said optical fiber spirit level connection end connected to said first surface of said spirit level whereupon said spirit level bubble is nearest said spirit level connection end of said light receiving optical fiber when said spirit level is in an uncanted orientation. The apparatus further includes a light transmitting and cant indicating optical fiber having a spirit level connection end and an orientation indication end, said optical fiber spirit level connection end connected to said second surface so as to be in substantial optical alignment with said optical fiber spirit level connection of said light receiving optical fiber, said orientation end illumination indicating at least one of a canted orientation and an uncanted orientation.

1 Claim, 8 Drawing Sheets

ANTI-CANT INDICATOR

This application claims priority from U.S. provisional application 62/424,890, filed on Nov. 21, 2106.

TECHNICAL FIELD

The present invention generally relates to the field of hunting, and, in particular, the anti-cant indicator apparatus.

BACKGROUND

In a long-range shooting, many factors that might not affect in a short-range shooting have a large impact on the ability to hit a target with dead-on accuracy. "Cant", which is defined as a tilting of a rifle/bow (projectile launcher or the like) to one side relative to the vertical axis of the earth, is one of those factors. Long-range shooters have long used rifle/bow scopes with levels to eliminate canting. The level is generally mounted either on the rifle/bow or on the rifle/bow scope, specifically on top of the rifle/bow scope tube, side of the rifle/bow scope tube, or on top of the rifle/bow. When aiming at the target with the rifle/bow scope, the long-range shooters need to make sure that the level on the rifle/bow or the rifle/bow scope is leveled by looking at the level and that the target is on the aiming point through an eyepiece of the rifle/bow scope at the same time. However, one-eyed shooters can focus on one or the other and even two-eyed shooters may have difficult time in paying the same degree of attentions to both the level and the eyepiece of the rifle/bow scope. As a result, this creates a subtle canting which results in a significant deviation from the planned impact point. In general, 6 degrees of a canting in 1,000-yard (i.e., 914 m) long-range shooting creates up to 3 feet (i.e., 91.4 cm) deviation from the target, which can result in missing the target.

Therefore, it would be desirable to provide an apparatus that cures the deficiencies of prior approaches.

SUMMARY

The present disclosure is directed to a cant indication apparatus. In one embodiment, the apparatus includes a spirit level having a first and second surface. In some embodiments, the apparatus includes said spirit level containing a first fluid. In some embodiments, the apparatus includes said first fluid having at least one of a first light transmittance and absorbance and a second fluid forming a bubble in said first fluid. In some embodiments, the apparatus includes said second fluid having at least one of a second light transmittance and absorbance. In some embodiments, the apparatus includes said bubble position indicating orientation. In some embodiments, the apparatus includes a light receiving optical fiber having a light receiving end and a spirit level connection end. In some embodiments, the apparatus includes said optical fiber spirit level connection end connected to said first surface of said spirit level whereupon said spirit level bubble is nearest said spirit level connection end of said light receiving optical fiber when said spirit level is in an uncanted orientation. In some embodiments, the apparatus includes a light transmitting and cant indicating optical fiber having a spirit level connection end and an orientation indication end. In some embodiments, the apparatus includes said optical fiber spirit level connection end connected to said second surface so as to be in substantial optical alignment with said optical fiber spirit level connection of said light receiving optical fiber. In some embodiments, the apparatus includes said orientation end illumination indicating at least one of a canted orientation and an uncanted orientation.

The foregoing is a summary and thus may contain simplifications, generalizations, inclusions, and/or omissions of detail; consequently, those skilled in the art will appreciate that the summary is illustrative only and is not intended to be in any way limiting. Other aspects, features, and advantages of the systems, products and/or methods and/or other subject matter described herein will become apparent in the teachings set forth herein. The accompanying drawings, which are incorporated in and constitute a part of the specification, illustrate embodiments of the disclosure and together with the general description, serve to explain the principles of the invention.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Reference will now be made in detail to the subject matter disclosed, which is illustrated in the accompanying drawings.

Referring generally to FIGS. 3-8, the present disclosure is generally directed to an anti-cant rifle/bow indication apparatus. Further, embodiments of the present disclosure are directed to sending an indication to a shooter via a rifle/bow scope eyepiece when a rifle/bow is leveled. This is accomplished by a spirit level vial filled up with a first fluid so as that when the spirit level vial is leveled, the bubble lines up with the light source, which allows the light to pass through the spirit level vial and to be transferred to the shooter's eye. Embodiments of the present disclosure further provides a non-battery operated anti-cant rifle/bow indication apparatus so as to provide a user-friendly and maintenance free anti-cant rifle/bow indication apparatus. The vial of the present invention may be filled with any two fluids of disparate densities and light transmittance and/or absorbance (Beer-Lamber-Bouguer law) such that significant light (photons) will either pass or not pass when the spirit level is uncanted (level) or canted (unlevel).

As used throughout the present disclosure, the terms "cant", "canting", or "canted" are generally defined by angular deviation from a vertical or horizontal plane or surface. In the hunting field, "cant", "canting", or "canted" is used to indicate a tilting of a gun to one side relative to the vertical axis of the earth. The term "canting error" is used to indicate an error associated with canting of a gun.

Figure 1A:
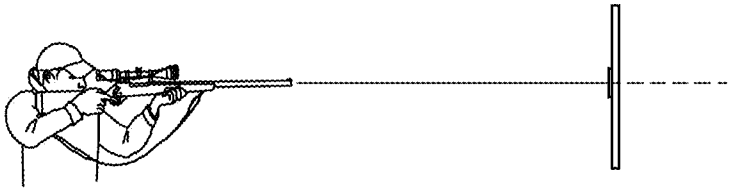
FIG. 1A illustrates a side view of a bullet trajectory of a short-range shooting.
Figure 1B:
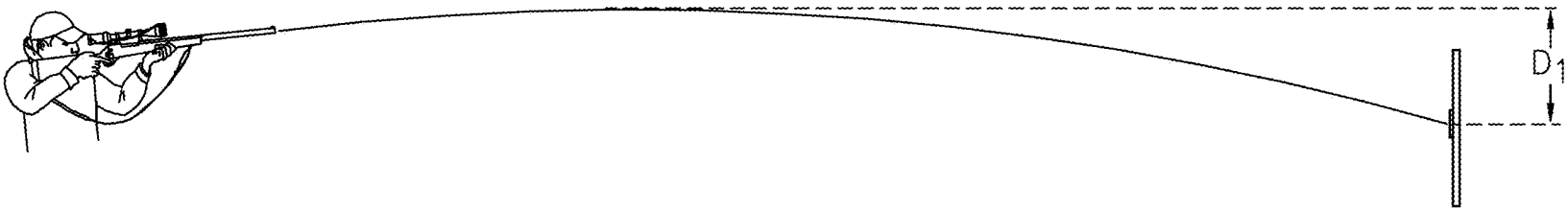
FIG. 1B illustrates a side view of a bullet trajectory of a long-range shooting.
Figure 2B:
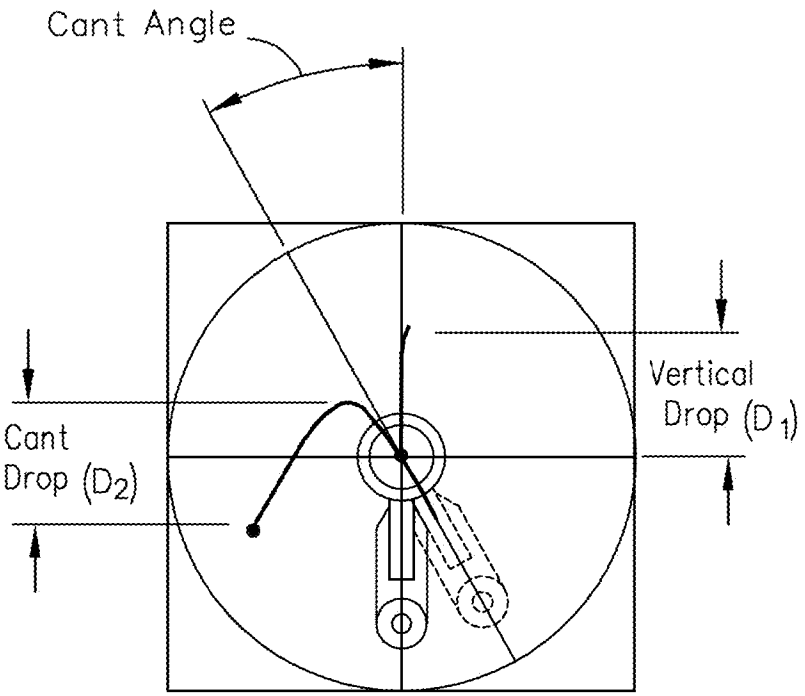
FIG. 2B illustrates an end view of the bullet trajectory with cant and uncant holds for a long-range shooting corresponding to FIG. 1B.
Figure 2A:
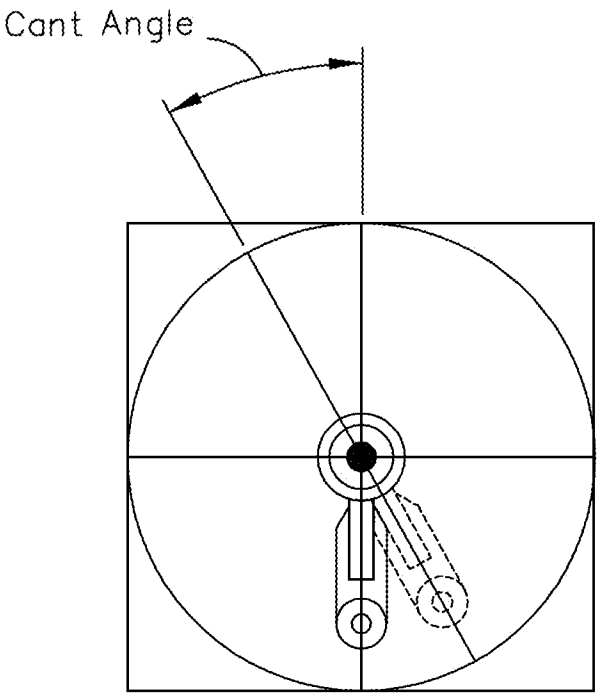
FIG. 2A illustrates an end view of the bullet trajectory with cant and uncant holds for a short-range shooting corresponding to FIG. 1A.

FIGS. 1A and 1B illustrate side views of a bullet trajectory of a short-range shooting and a long-range shooting, respectively. FIGS. 2A and 2B illustrate a comparison of bullet with cant hold and uncant hold trajectories for a short-range shooting and a long-range shooting, respectively.

FIG. 1A illustrates a side view of a bullet trajectory of a short-range shooting. In a shot-range shooting, a distance that a bullet travels from a rifle/bow to a center of a target is short so as that the bullet experiences practically negligible gravity force. In this regard, the bullet travels straight from the rifle/bow to the center of the target and an elevation of the bullet fired at the rifle/bow is the same as an elevation of the center of the target hit by the bullet. In other words, the bullet experiences no vertical drop in this case.

FIG. 2A illustrates an end view of the bullet trajectory with cant and uncant holds for a short-range shooting corresponding to FIG. 1A. Since the bullet travels straight from the rifle/bow to the center of the target as shown in FIG. 1A (i.e., no vertical drop), the bullet hits the center of the target even with the cant hold. In this case, holding the rifle/bow uncanted has negligible impact on where the bullet lands. In other words, for both cases (i.e., cant or uncant holds) the bullet ends up landing on the center of the target. In this regard, for the short-range shooting, canting errors have no impact on a shooting accuracy.

FIG. 1B illustrates a side view of a bullet trajectory of a long-range shooting. In a long-range shooting, a distance that a bullet travels from a rifle/bow to a center of a target is long so as that the bullet experiences gravity force, which results in the bullet trajectory to have an arc as shown in FIG. 1B. In this regard, the bullet travels via an arced bullet trajectory (i.e., a bullet projectile) from the rifle/bow to the center of the target and an elevation of the bullet fired at the rifle/bow is different from an elevation of the center of the target hit by the bullet. The vertical drop is defined as a vertical distance between an apex of trajectory and a bullet impact point. In the long-range shooting, a shooter needs to account for the vertical drop $D_1$ of the bullet and its effect in order to hit the center of the target accurately. A cant angle has a large impact on a bullet projectile, which, in turn, affects a bullet impact point considerably.

FIG. 2B illustrates an end view of the bullet trajectory with cant and uncant holds for a long-range shooting corresponding to FIG. 1B. Since the bullet travels via an arced bullet trajectory from the rifle/bow to the center of the target, the bullet lands on different places depending on canting angles. When the rifle/bow is held uncanted (i.e., vertical hold), the bullet travels via the vertical trajectory, passes the apex of the vertical trajectory, and lands on the center of the target. The bullet experiences the vertical drop $D_1$ as shown in FIG. 2B. When the rifle/bow is held canted (i.e., cant hold), the bullet travels via a different bullet trajectory, passes an apex of cant trajectory, and lands on an impact point of the cant hold as shown in FIG. 2B. The bullet experiences the vertical drop $D_2$. It is noted that, while the bullet impact points for the uncant hold and cant hold are different, the vertical drops $D_1$ and $D_2$ of the bullet trajectories with the uncant hold and cant hold, respectively, are the same due to the gravity force applied onto the bullets. The gravity force pulls the bullet straight down vertically to the ground. The gravity force and the cant angle cause the bullet to diverge from the vertical trajectory, thereby missing the target. This becomes more significant at more distant targets.

FIGS. 3-8 illustrate an anti-cant rifle/bow indication apparatus 300, in accordance with one or more embodiments of the present disclosure.

Figure 3:
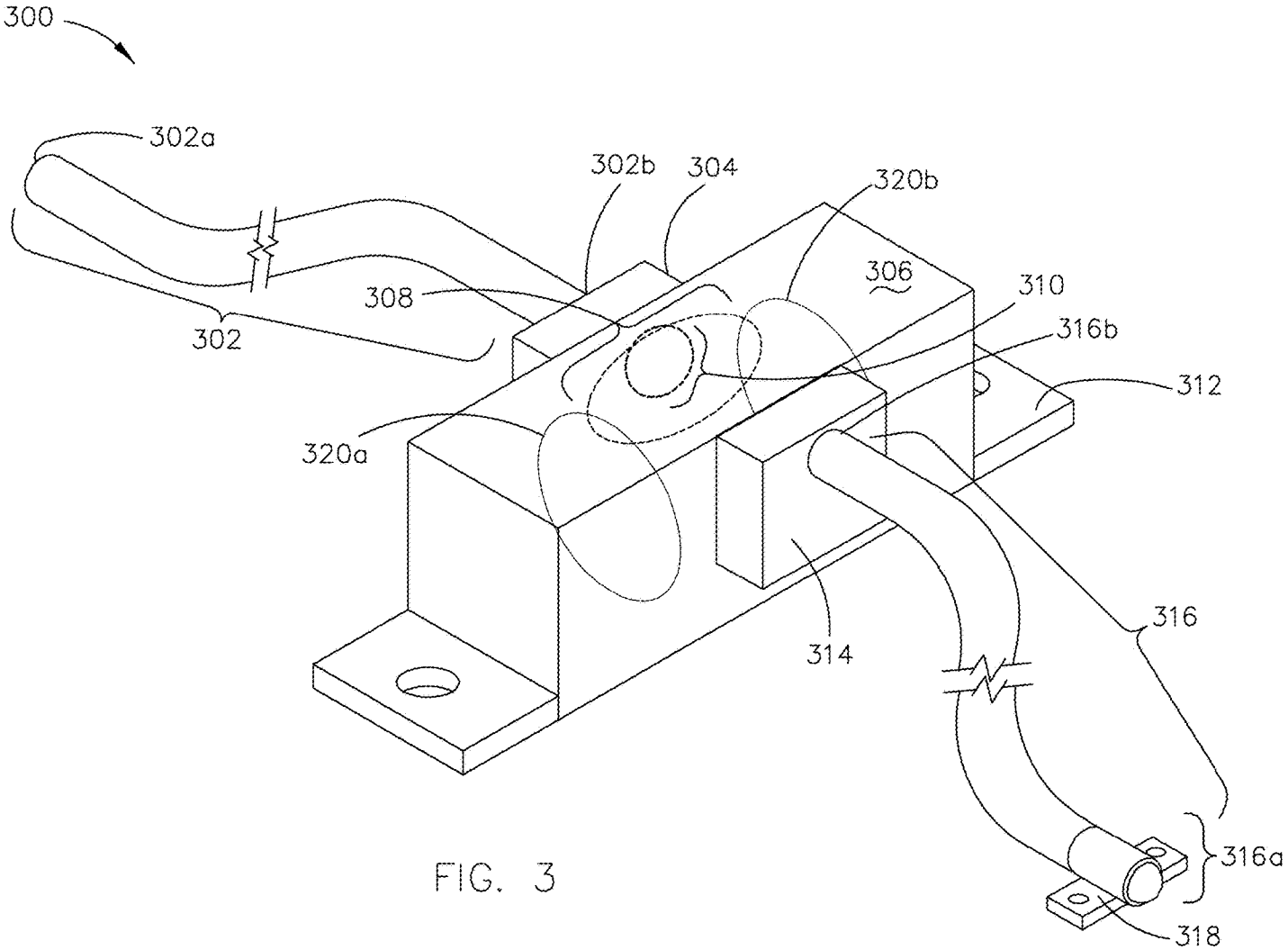
FIG. 3 illustrates an anti-cant rifle/bow indicator apparatus, in accordance with one or more embodiments of the present disclosure.

Referring now to FIG. 3, in one embodiment, an anti-cant rifle/bow indication apparatus 300 may include a light collecting end 302*a* of a first fiber 302 for collecting a light. For example, the light collected by the light collecting end 302*a* of the first fiber 302 may be natural light. By way of another example, the natural light may be a sunlight. For instance, the natural light may be a moon light. It is noted that the natural light may include any natural light known in the art capable of providing a light source.

In some embodiments, the light collected by the light collecting end 302*a* of the first fiber 302 may be artificial light. For example, the artificial light may be a light from electroluminescence including, but not limited to, a light-emitting-diode (LED). By way of another example, the artificial light may be caused by an electric discharge including, but not limited to, a lamp. It is noted that any artificial light which does not damage human eyes may be utilized in the present disclosure as the light source, such as, but not limited to, photoluminescence lights, electrochemiluminescence lights, chemiluminescence lights, bioluminescence lights, or the like.

In some embodiments, the anti-cant rifle/bow indication apparatus 300 may be equipped with objective lenses (not shown) to focus the light on the collecting end 302*a* of the first fiber 302. It is noted that any objective lens known in the art gathering and focusing the light may be utilized in the present disclosure to provide the light source to the light collecting end 302*a* of the first fiber 302.

In one embodiment, the anti-cant rifle/bow indication apparatus 300 may include a first fiber 302 configured to transmit a light collected by the light collecting end 302*a* of the first fiber 302 to a first connecting end 302*b* of the first fiber 302. For example, the first fiber 302 may be an optical fiber. By way of another example, the optical fiber may be a bundle of optical fibers so as to collect and transmit the light from the light source effectively between the light collecting end 302*a* of the first fiber 302 and the first connecting end 302*b* of the first fiber 302. For instance, the connecting end 302*b* of the first fiber 302 may be connected to a spirit level vial 306 via a first connector 304, which is described herein thereafter.

In some embodiments, the first fiber 302 may be formed from any optical fiber material known in the art including, but not limited to, silica, fluoride glass, phosphate glass, or chalcogenide glass. In some embodiments, the first fiber 302 may be a flexible optical fiber. For example, the first fiber 302 may need to be bent in order to accommodate various rifle/bow scope shapes and sizes.

In some embodiments, a length of the first fiber 302 may be selected so as to fit various rifle/bow scope models. For example, the first fiber 302 may be mounted on top of a rifle/bow scope to receive the light effectively and the length of the first fiber 302 may need to be long enough to reach the top of the rifle/bow scope. This varies from a rifle/bow scope to a rifle/bow scope. In this regard, the first fiber 302 of the anti-cant rifle/bow indication apparatus 300 is customizable to meet various rifle/bow scope sizes and shapes as well as various locations for the anti-cant rifle/bow indication apparatus 300 to be installed on the rifle/bow scope or the rifle/bow.

In one embodiment, the anti-cant rifle/bow indication apparatus 300 may include a second fiber 316 configured to transmit a light collected at the light collecting end 302*a* of the first fiber 302 via an air pocket 308 of a spirit level vial 306. For example, the second fiber 316 may be an optical fiber. By way of another example, the optical fiber may be a bundle of optical fibers so as to collect and transmit the light from the air pocket 308 of the spirit level vial 306 effectively between a second connecting end 316*b* of the second fiber 316 and an indicator end 316*a* of the second fiber 316. For instance, the second connecting end 316*b* of the second fiber 316 may be aligned with the air pocket 308 of the spirit level vial 306. In another instance, the indicator end 316*a* of the second fiber 316 may be connected to an eyepiece of the rifle/bow scope.

In some embodiments, the second fiber 316 may be formed from any optical fiber material known in the art including, but not limited to, silica, fluoride glass, phosphate glass, or chalcogenide glass. In some embodiments, the second fiber 316 may be a flexible optical fiber. For example, the second fiber 316 may need to be bent in order to accommodate various rifle/bow scope shapes and sizes.

In some embodiments, a length of the second fiber 316 may be selected so as to fit various rifle/bow scope models. For example, the second fiber 316 may be mounted on eyepiece of a rifle/bow scope so that the light is effectively sent to the shooter's eyes and the length of the second fiber 316 may need to be long enough to reach the eyepiece of the rifle/bow scope. This varies from a rifle/bow scope to a rifle/bow scope. In this regard, the second fiber 316 of the anti-cant rifle/bow indication apparatus 300 is customizable to meet various rifle/bow scope sizes and shapes as well as various locations for the anti-cant rifle/bow indication apparatus 300 to be installed on the rifle/bow scope or the rifle/bow.

In some embodiments, the indicator end 316*a* of the second fiber 316 may be equipped with an attachment 318 configured to be mounted on the eyepiece of the rifle/bow scope. For example, the attachment 318 may include any attachment method known in the art suitable for mounting on a rifle/bow scope including, but not limited to, a magnet, a clip, a screw, a bolt, a clamp, a VELCRO, a tie, or a glue.

In one embodiment, the anti-cant rifle/bow indication apparatus 300 may include a spirit level vial 306 for indicating an orientation of the anti-cant rifle/bow indication apparatus 300 relative to the vertical axis of the earth. For example, any off-centered orientation relative to the vertical axis of the earth may be indicated by an air pocket 308 of the spirit level vial 306 not being at the center of the spirit level vial 306. In some embodiments, the spirit level vial 306 may be any spirit level vial in the art designed to indicate whether a rifle/bow is leveled horizontally. For example, the spirit level vial 306 may include a carpenter's level including, but not limited to, a tubular type level.

In some embodiments, the spirit level vial 306 of the anti-cant rifle/bow indication apparatus 300 may be filled with, for example, a dark fluid (not shown for clarity). For example, the dark fluid of the spirit level vial 306 may be a colored sprit or alcohol. By way of another example, the colored sprit or alcohol may be a combination of a spirit or alcohol with a dye. For instance, a type and the amount of the dye may be selected so that the fluid of the spirit level vial 306 is dark enough to block a light from one side to the other side. Such a dye may include, but is not limited to, a leather dye.

In some embodiments, the dark fluid of the spirit level vial 306 may have a selected air pocket 308 size. For example, the dark fluid of the spirit level vial 306 preferably has an air pocket (bubble) 308 with a diameter of between fifty percent (50%) to one-hundred fifty percent (150%) of the diameter of the optical fiber 302, 316. In a presently preferred embodiment the circumference of the bubble 308 is correspondingly and generally sized such that it is substantially equal to the circumference of the optical fiber 302, 316. By way of another example, the air pocket 308 size may be selected so as to satisfy the anti-cant requirements from the shooter. For instance, a smaller air pocket size of the spirit level vial 306 may be suitable for the shooter with high precision requirements. By another instance, a larger air pocket size of the spirit level vial 306 may be suitable for the shooter with relatively low precision requirements. The degree of the canting error may be controlled by the air pocket size of the spirit level vial 306. In general, the smaller the air pocket size of the spirit level vial 306 the more accurate the indication will be.

In some embodiments, the spirit level vial 306 of the anti-cant rifle/bow indication apparatus 300 may be connected to both the first connecting end 302*b* of the first fiber 302 and the second collecting end 316*b* of the second fiber 316. For example, a surface of the spirit level vial 306 may be connected to the first connecting end 302*b* of the first fiber 302 and an opposite surface of the spirit level vial 306 may be connected to the second collecting end 316*b* of the second fiber 316. By way of another example, the location of the first connecting end 302*b* of the first fiber 302 may be selected so that an attachment surface 310 of the first connecting end 302*b* of the first fiber 302 may be aligned mostly within the air pocket 308 of the spirit level vial 306 when the spirit level vial 306 is leveled. By way of yet another example, the location of the second connecting end 316*b* of the second fiber 316 may be selected so that an attachment surface (not shown due to the drawing angle) of the second connecting end 316*b* of the second fiber 316 may be aligned mostly within the air pocket 308 of the spirit level vial 306 when the spirit level vial 306 is leveled. In this regard, when the spirit level vial 306 is leveled, the air pocket 308 may line up with the first connecting end 302*b* of the first fiber 302 on one end and the second connecting end 316*b* of the second fiber 316 on the other end so that the light collected at the light collecting end 302*a* of the first fiber 302 may be transmitted through and reached all the way down to the indicator end 316*a* of the second fiber 316 via the air pocket 308 of the spirit level vial 306.

In general, a spirit level vial is constructed such that it has a barrel-shaped tube with a slightly larger diameter in its middle so as that the air pocket naturally rests in the center when it is leveled. Due to this construction feature of the spirit level vial, the air pocket occupies a space in a top center portion of the spirit level vial when it is leveled. In this regard, the first connecting end 302*b* of the first fiber 302 and the second connecting end 316*b* of the second fiber 316 may be connected to the top center portion of the spirit level vial 306 as shown in FIG. 3. It is noted that, while the first connecting end 302*b* of the first fiber 302 and the second connecting end 316*b* of the second fiber 316 shown in FIG. 3 are connected to the top center portion of the spirit level vial 306, such a configuration is merely provided for illustrative purposes.

It is contemplated that, while the spirit level vial 306 depicted in FIG. 3 is presently preferably a cuboid-shaped level vial, such a configuration is merely provided for illustrative purposes. The present disclosure may be configured to utilize other level vial shapes such as a cylinder-shaped level vial.

In one embodiment, the anti-cant rifle/bow indication apparatus 300 may include markings 320*a* and 320*b* for the spirit level vial 306 to indicate how leveled the spirit level vial 306 is. For example, the air pocket 308 located within the markings 320*a* and 320*b* indicates that the spirit level vial 306 of the anti-cant rifle/bow indication apparatus 300 is properly leveled. On the other hand, the air pocket 308 located slightly off to one side of the marking 320*a* or 320*b* indicates that the spirit level vial 306 of the anti-cant rifle/bow indication apparatus 300 needs an adjustment in order to be properly leveled. It is noted that embodiments of the present disclosure may be equipped with other marking configurations including, but not limited to, a finer marking configuration or a gauge marking configuration for more accurate level indication.

In one embodiment, the anti-cant rifle/bow indication apparatus 300 may include a spirit level vial anchor 312 for mounting the spirit level vial 306 onto a rifle/bow or a rifle/bow scope securely. The spirit level vial anchor 312 may include any anchoring mechanism known in the art for securely mounting an object onto a flat surface. For example, the spirit level vial anchor 312 may be equipped with magnetic plates for attaching the spirit level vial anchor 312 to a metal portion of the rifle/bow or the rifle/bow scope. By way of another example, the spirit level vial anchor 312 may be equipped with metal plate brackets so as to attach the spirit level vial anchor 312 to the rifle/bow or the rifle/bow scope with screws, bolts, or the like.

In one embodiment, the anti-cant rifle/bow indication apparatus 300 may include a first connector 304 and a second connector 314 for mounting the first fiber 302 and the second fiber 316 to the spirit level vial 306, respectively. For example, the first connector 304 may be configured to attach the first connecting end 302*b* of the first fiber 302 to a first surface of the spirit level vial 306 where air pocket 308 of the spirit level vial 306 would be rested when the spirit level vial 306 of the anti-cant rifle/bow indication apparatus 300 is leveled. By way of another example, the second connector 314 may be configured to attach the second connecting end 316*b* of the second fiber 316 to a second surface of the spirit level vial 306 where air pocket 308 of the spirit level vial 306 would be rested when the spirit level vial 306 of the anti-cant rifle/bow indication apparatus 300 is leveled. It is noted that the first surface that the first connecting end 302*b* of the first fiber 302 is attached to and the second surface that the second connecting end 316*b* of the second fiber 316 is attached to are located on opposite sides of the center of the spirit level vial 306.

Figure 4C:
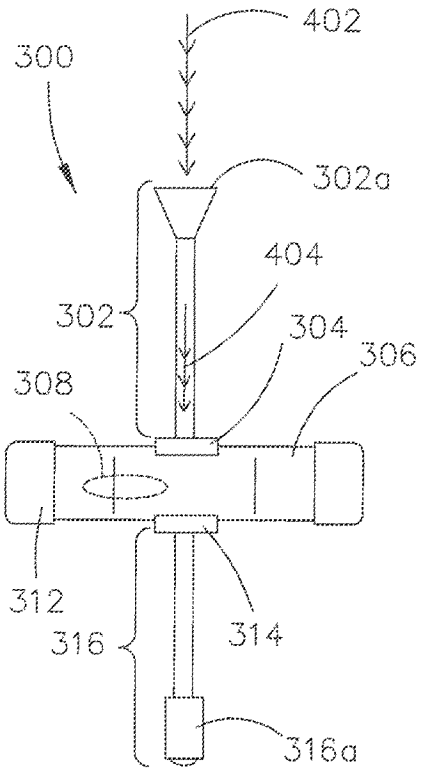
FIG. 4C illustrates a top elevation view of the anti-cant rifle/bow indication apparatus with a canting error is disclosed, in accordance with one or more embodiments of the present disclosure.
Figure 4B:
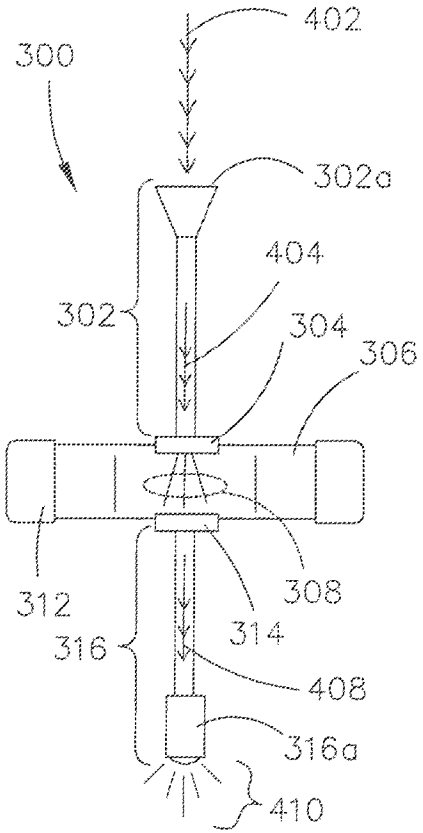
FIG. 4B illustrates a top elevation view of the anti-cant rifle/bow indication apparatus without a canting error is disclosed, in accordance with one or more embodiments of the present disclosure.
Figure 4A:
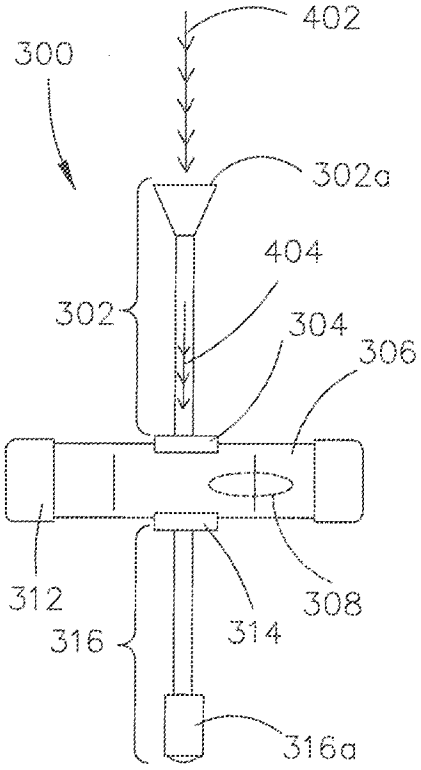
FIG. 4A illustrates a top elevation view of the anti-cant rifle/bow indication apparatus with a canting error is disclosed, in accordance with one or more embodiments of the present disclosure.

Now referring to FIGS. 4A-4C, top elevation views of the anti-cant rifle/bow indication apparatus 300 with and without a canting error are disclosed, in accordance with one or more embodiments of the present disclosure. It is noted herein that the embodiments and components described previously herein with respect to the apparatus 300 should be interpreted to extend to the embodiments described in FIGS. 4A-4C.

FIG. 4A is an illustration depicting a top elevation view of the anti-cant rifle/bow indication apparatus 300 with a canting by tilting the rifle/bow to the left relative to the vertical axis of the earth.

In one embodiment, the anti-cant rifle/bow indication apparatus 300 may not be leveled. For example, the anti-cant rifle/bow indication apparatus 300 may be canted. By way of another example, the canting may be indicated by the light 404 from the light source 402 not passing through the spirit level vial 306 of the anti-cant rifle/bow indication apparatus 300. For instance, the air pocket 308 of the spirit level vial 306 may not be located at the center of the spirit level vial 306. In FIG. 4A the air pocket 308 of the spirit level vial 306 is depicted to rest in the right portion of the spirit level vial 306. In this regard, the air pocket 308 of the spirit level vial 306 is not lined up with the light 404 from the light source 402 via the first fiber 302 and the light 404 from the light source 402 is blocked by the dark fluid (not shown for clarity) of the spirit level vial 306. The shooter looking from the eyepiece of the rifle/bow scope equipped with the indicator end 316*a* of the second fiber 316 does not get the indication that the spirit level vial 306 of the anti-cant rifle/bow indication apparatus 300 is leveled.

FIG. 4B is an illustration depicting a top elevation view of the anti-cant rifle/bow indication apparatus 300 without a canting. In one embodiment, the anti-cant rifle/bow indication apparatus 300 may be leveled. For example, the anti-cant rifle/bow indication apparatus 300 may include the air pocket 308 of the spirit level vial 306 rested at the center of the spirit level vial 306. By way of another example, the air pocket 308 of the spirit level vial 306 may be transparent. For instance, the air pocket 308 of the spirit level vial 306 may transmit the light 404 from the light source 402 as a transmitted light 408 within the second fiber 316. In another instance, the transmitted light 408 may exit from the indicator end 316*a* of the second fiber 316 and emit a light 410.

It is noted that the light 404 from the light source 402 may pass through the air pocket 308 and reach the indicator end 316*a* of the second fiber 316 when the spirit level vial 306 of the anti-cant rifle/bow indication apparatus 300 is leveled. In this regard, the shooter gets an indication that the spirit level vial 306 of the anti-cant rifle/bow indication apparatus 300 is leveled when the shooter sees the light 410 from the indicator end 316*a* of the second fiber 316.

FIG. 4C is an illustration depicting a top elevation view of the anti-cant rifle/bow indication apparatus 300 with a canting by tilting the rifle/bow to the right relative to the vertical axis of the earth.

In one embodiment, the anti-cant rifle/bow indication apparatus 300 may not be leveled. For example, the anti-cant rifle/bow indication apparatus 300 may be canted. By way of another example, the canting may be indicated by the light not passing through the spirit level vial 306 of the anti-cant rifle/bow indication apparatus 300. For instance, the air pocket 308 of the spirit level vial 306 may not be located at the center of the spirit level vial 306. In FIG. 4C the air pocket 308 of the spirit level vial 306 is depicted to rest in the left portion of the spirit level vial 306. In this regard, the air pocket 308 of the spirit level vial 306 is not lined up with the light source 402 via the first fiber 302 and the light 404 from the light source 402 is blocked by the dark fluid (not shown for clarity) of the spirit level vial 306. The shooter looking from the eyepiece of the rifle/bow scope equipped with the indicator end 316*a* of the second fiber 316 does not get the indication that the spirit level vial 306 of the anti-cant rifle/bow indication apparatus 300 is leveled.

Figure 5C:
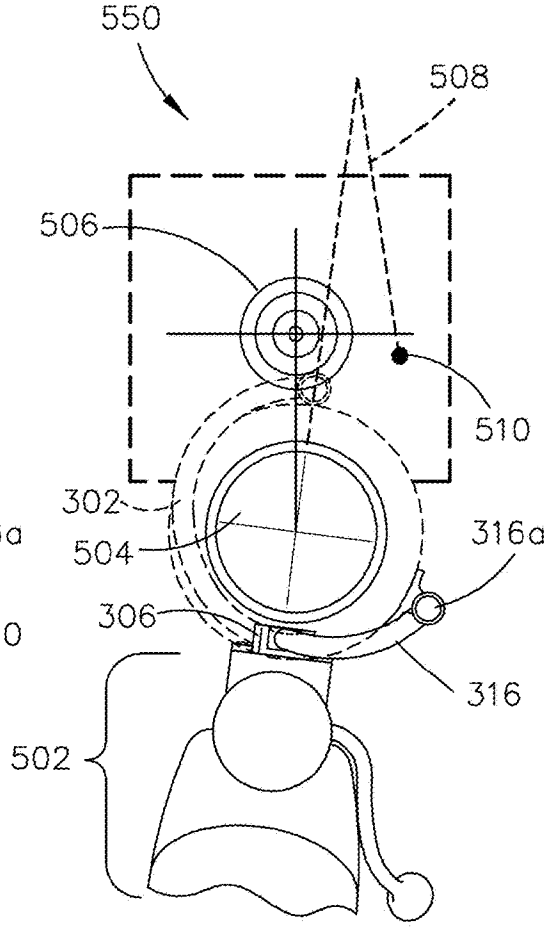
FIG. 5C illustrates a shooter's view of the anti-cant rifle/bow indication apparatus with a canting error is disclosed, in accordance with one or more embodiments of the present disclosure.
Figure 5B:
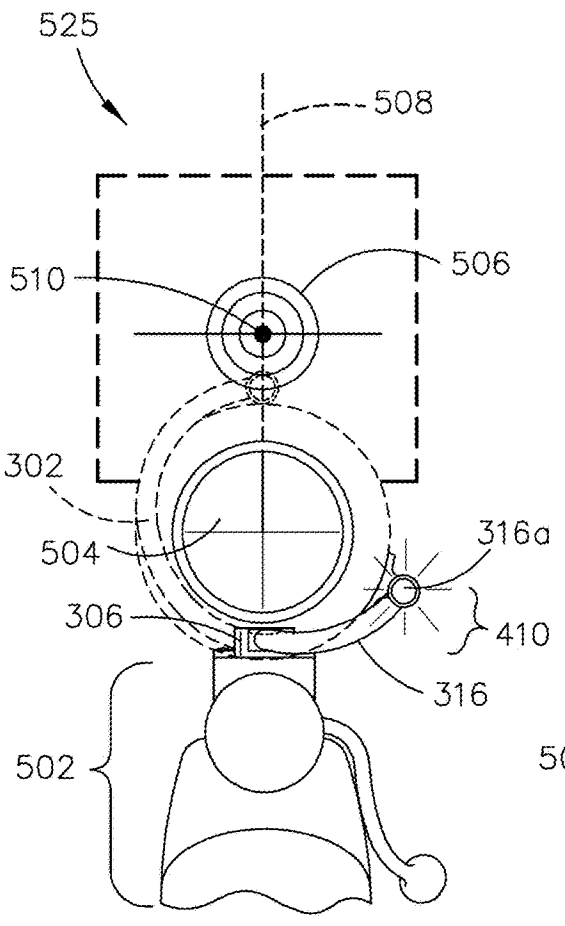
FIG. 5B illustrates a shooter's view of the anti-cant rifle/bow indication apparatus without a canting error is disclosed, in accordance with one or more embodiments of the present disclosure.
Figure 5A:
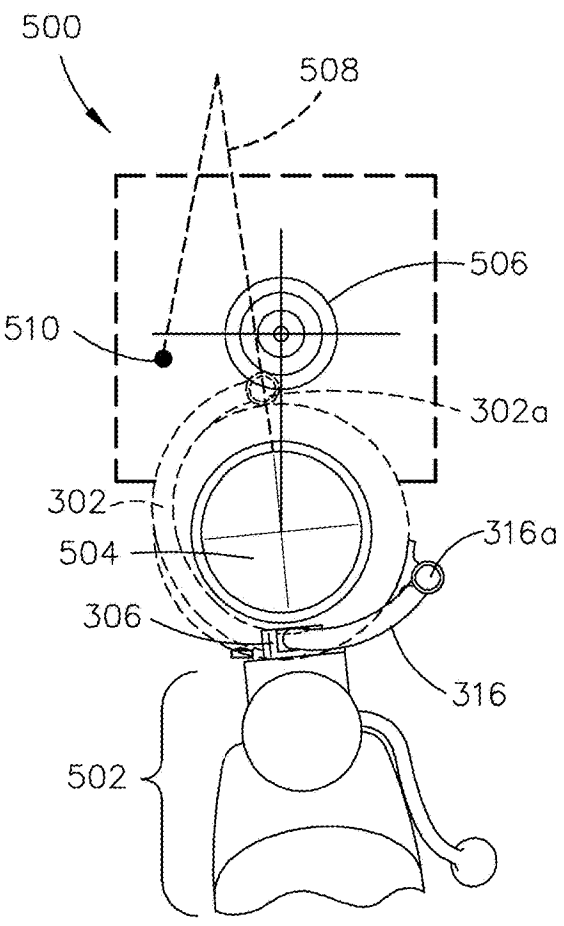
FIG. 5A illustrates a shooter's view of the anti-cant rifle/bow indication apparatus with a canting error is disclosed, in accordance with one or more embodiments of the present disclosure.

Now referring to FIGS. 5A-5C, shooter's views of the anti-cant rifle/bow indication apparatus 300 with and without a canting error are disclosed, in accordance with one or more embodiments of the present disclosure. It is noted herein that the embodiments and components described previously herein with respect to the apparatus 300 should be interpreted to extend to the embodiments described in FIGS. 5A-5C. FIGS. 5A and 5C depict canting effects on both the angles of the rifle/bow relative to the vertical axis of the earth and the impact points. The shooter's views shown in FIGS. 5A-5C correspond to the spirit level vial configurations shown in FIGS. 4A-4C.

FIG. 5A is an illustration depicting a shooter's view of the anti-cant rifle/bow indication apparatus 300 with a canting by tilting the rifle/bow to the left relative to the vertical axis of the earth. In one embodiment, the shooter's view 500 may include a rifle/bow 502, a rifle/bowscope eyepiece 504, a target 506, a bullet trajectory 508, and an impact point 510 of the bullet. The light collecting end 302*a* of the first fiber 302, the first fiber 302, the spirit level vial 306, the second fiber 316, and the indicator end 316*a* of the second fiber of the anti-cant rifle/bow indication apparatus 300 are shown in FIG. 5A to demonstrate the effectiveness of the anti-cant rifle/bow indication apparatus 300 and a mounting configuration of the anti-cant rifle/bow indication apparatus 300 on the rifle/bow from the shooter's view. It is noted that the shooter's view shown in FIG. 5A is provided to show an exaggerated canting view for the purpose of illustration.

In general, when the canting is introduced, the rifle/bow 502 and the rifle/bow scope 504 may be tilted relative to the vertical axis of the earth. In this case 500, the rifle/bow 502 and the rifle/bow scope 504 may be tilted to the left relative to the vertical axis of the earth, which moves the air pocket 308 of the spirit level vial 306 to the right portion of the spirit level vial 306 as shown in FIG. 4A. It is noted that under this condition the light 404 from the light source 402 is not transmitted through the air pocket 308 of the spirit level vial 306 and this results in no indicator light 410 lit at the indicator end 316*a* of the second fiber 316 as shown in FIGS. 4A and 5A. This translates that the bullet trajectory 508 from the rifle/bow 502 is also projected to the left of the target 506. This bullet trajectory 508 forces the bullet from the rifle/bow 502 to land on the impact point 510, which is on lower left side of the target 506. This results in missing the target 506.

FIG. 5B is an illustration depicting a shooter's view of the anti-cant rifle/bow indication apparatus 300 without a canting of a rifle/bow. The shooter's view 525 shows that the rifle/bow 502 and the rifle/bow scope 504 are perfectly leveled utilizing the anti-cant rifle/bow indication apparatus 300. Under this condition, the light 404 from the light source 402 lines up with the air pocket 308 of the spirit level vial 306, which transmits the light 404 from the first fiber 302 to the second fiber 316 and reaches the indicator end 316*a* of the second fiber 316. This generates the light 410 at the indicator end 316*a* to indicate that the rifle/bow 502 and the rifle/bow scope 504 are not canted. The light 410 is observable from the shooter's view 525 at the indicator end 316*a* as shown in FIG. 5B. In response, the bullet from the rifle/bow 502 travels straight to the target 506 via the bullet trajectory 508 and the impact point 510 and the center of the target 506 are perfectly lined up. It should be noted that a lack of illumination may indicate an uncanted orientation and at least some level of illumination may indicate a canted orientation depending on the light transmittance and/or absorbance of the bubble fluid. Likewise, illumination may indicate an uncanted orientation and at least some level of partial illumination may indicate a canted orientation depending on the light transmittance and/or absorbance of the bubble fluid.

FIG. 5C is an illustration depicting a shooter's view of the anti-cant rifle/bow indication apparatus 300 with a canting by tilting the rifle/bow to the right relative to the vertical axis of the earth. It is noted that the shooter's view shown in FIG. 5C is provided to show an exaggerated canting view for the purpose of illustration.

In general, when the canting is introduced, the rifle/bow 502 and the rifle/bow scope 504 may be tilted relative to the vertical axis of the earth. In this case 550, the rifle/bow 502 and the rifle/bow scope 504 may be tilted to the right relative to the vertical axis of the earth, which moves the air pocket 308 of the spirit level vial 306 to the left portion of the spirit level vial 306 as shown in FIG. 4C. It is noted that under this condition the light 404 from the light source 402 is not transmitted through the air pocket 308 of the spirit level vial 306 and this results in no indicator light 410 lit at the indicator end 316*a* of the second fiber 316 as shown in FIGS. 4C and 5C. This translates that the bullet trajectory 508 from the rifle/bow 502 is also projected to the right of the target 506. This bullet trajectory 508 forces the bullet from the rifle/bow 502 to land on the impact point 510, which is on lower right side of the target 506. This results in missing the target 506.

It is noted that the anti-cant rifle/bow indication apparatus 300 does not require the shooter to look at two physically separated sites to check whether or not the rifle/bow and/or the rifle/bow scope is leveled as demonstrated and shown in FIGS. 5A-5C. Since the indicator end 316*a* of the second fiber 316 of the anti-cant rifle/bow indication apparatus 300 is attached to the eyepiece of the rifle/bow scope 504, the light 410 from the anti-cant rifle/bow indication apparatus 300 may be easily recognizable by one eye. This may reduce a subtle canting error significantly because an eyesight from the shooter captures both a rifle/bow scope lens (e.g., eyepiece, exit pupil, or the like) and the indicator end 316*a* of the anti-cant rifle/bow indication apparatus 300 at the same time.

It is contemplated that, while the indicator end 316*a* of the second fiber 316 is attached on bottom right portion of the scope eyepiece 504 shown in FIGS. 5A-5C, such a configuration is merely provided for illustrative purposes. Embodiments of the present disclosure may be configured to be equipped with the indicator end 316*a* of the second fiber 316 on any position of the rifle/bow scope eyepiece, such as, but not limited to, on the top, bottom, right side, or left side of the rifle/bow scope eyepiece.

Figure 6:
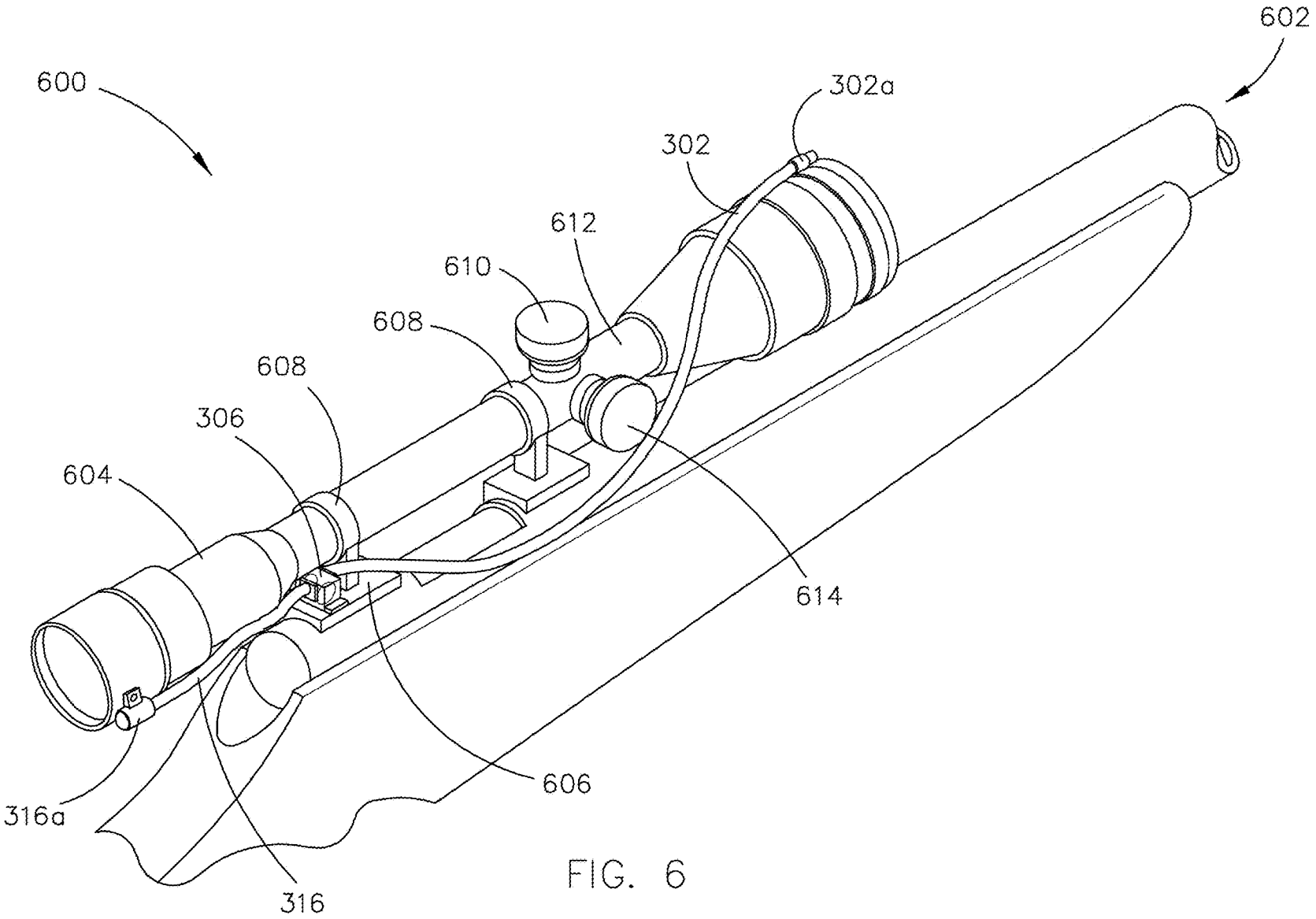
FIG. 6 illustrates a mounting configuration of the anti-cant rifle/bow indication apparatus, in accordance with one or more embodiments of the present disclosure.

FIG. 6 illustrates a mounting configuration 600 of the anti-cant rifle/bow indication apparatus 300, in accordance with one or more embodiments of the present disclosure. It is noted herein that the embodiments and components described previously herein with respect to the apparatus 300 should be interpreted to extend to the embodiments described in FIG. 6.

In general, a level for a rifle/bow can be mounted directly on a rifle/bow. For example, the level mounted on the rifle/bow is typically placed on a flat portion of the rifle/bow, such as, but not limited to, a Weaver rail mount or Picatinny rail (or the like). Also, the level for a rifle/bow can be mounted directly on a rifle/bow scope. For example, the level mounted on the rifle/bow scope is typically placed on a flat portion of the rifle/bow scope including, but not limited to, a top of a rifle/bow scope tube or a side of the rifle/bow scope tube (via an adapter or the like). The spirit level vial 306 of the anti-cant rifle/bow indication apparatus 300 in the present disclosure may be mounted perpendicular to the axis of the barrel on any flat portion of the rifle/bow as well as the rifle/bow scope.

In one embodiment, the anti-cant rifle/bow indication apparatus 300 may be mounted on a rifle/bow 602. For example, the anti-cant rifle/bow indication apparatus 300 may be mounted on a flat surface of a top of the rifle/bow 602. The spirit level vial 306 of the anti-cant rifle/bow indication apparatus 300 may be placed perpendicular to the rifle/bow 602 in order to correctly detect canting of the rifle/bow. By way of another example, the flat surface of the top of the rifle/bow 602 may include a mounting rail 606 of the rifle/bow 602. For instance, the anti-cant rifle/bow indication apparatus 300 may be fixed on top of the rifle/bow 602 by any attaching method known in the art, such as, but not limited to, a magnet, a clip, a screw, a bolt, a clamp, a VELCRO, a tie, and a glue.

In some embodiments, the anti-cant rifle/bow indication apparatus 300 may be mounted on a rifle/bow scope 604. For example, the anti-cant rifle/bow indication apparatus 300 may be mounted on a flat surface of a top of the rifle/bow scope 604. The spirit level vial 306 of the anti-cant rifle/bow indication apparatus 300 may be placed perpendicular to the rifle/bow in order to correctly detect canting of the rifle/bow. By way of another example, the flat surface of the top of the rifle/bow scope 604 may include, but is not limited to, scope holders 608, a protection cap or elevation adjustment cap 610, or a scope tube 612. For instance, the anti-cant rifle/bow indication apparatus 300 may be fixed on top of the rifle/bow scope 604 by any attaching method known in the art, such as, but not limited to, a magnet, a clip, a screw, a bolt, a clamp, a VELCRO, a tie, and a glue.

In some embodiments, the spirit level vial 306 of the anti-cant rifle/bow indication apparatus 300 may be mounted on any flat vertical surface of the rifle/bow scope 604 including, but not limited to, scope holders 608, a scope tube 612, a windage adjustment cap 614, or a side focus adjustment cap (not shown) using the spirit level vial anchor 312 of the anti-cant rifle/bow indication apparatus 300. In some embodiments, the spirit level vial 306 of the anti-cant rifle/bow indication apparatus 300 may be securely installed with the spirit level vial anchor 312 on the flat vertical surface of the rifle/bow scope 604 so that the spirit level vial 306 is perpendicular to the rifle/bow in order to correctly detect a canting of the rifle/bow.

In one embodiment, the light collecting end 302*a* of the first fiber 302 may be faced toward a natural light source. For example, the light collecting end 302*a* of the first fiber 302 may be fixed on top of the rifle/bow scope 604 so as to collect natural light effectively.

It is contemplated that, while the light collecting end 302*a* of the first fiber 302 shown in FIG. 6 is mounted on top of the rifle/bow scope 604, such a configuration is merely provided for illustrative purposes. The present disclosure may be configured to adapt other mounting locations such as, but not limited to, a side of the rifle/bow scope 604, a top of the rifle/bow 602, or a side of the rifle/bow 602.

In some embodiments, the anti-cant rifle/bow indication apparatus 300 may collect natural light directly to the spirit level vial 306. In this regard, the first fiber 302 of the anti-cant rifle/bow indication apparatus 300 may not be required (not shown). For example, when the spirit level vial 306 of the anti-cant rifle/bow indication apparatus 300 is placed on top of the rifle/bow scope 604 including, but not limited to, scope holders 608, a scope tube 612, a windage adjustment cap 614, or a side focus adjustment cap (not shown), light from the sun may be utilized to send the light to the anti-cant indication apparatus 300. When the rifle/bow scope is leveled, the light from the sun passes through the air pocket in the spirit level vial 306 of the anti-cant rifle/bow indication apparatus 300 and light the indicator end 316*a* of the second fiber 316 attached to the eyepiece of the rifle/bow scope 604.

In some embodiments, the light collecting end 302*a* of the first fiber 302 may be connected to an artificial light source including, but not limited to, a light-emitting diode (LED). For example, the artificial light source may provide the light to the spirit level vial 306 via the light collecting end 302*a* of the first fiber 302 so as to send the light indication to the shooter at the indicator end 316*a* via the second fiber 316 when the spirit level vial does not experience a canting. This may be beneficial when there is not enough natural light available in the hunting field.

It is contemplated that, while the lengths of the first fiber 302 and the second fiber 316 shown in FIG. 6 are depicted such that the first fiber 302 is longer than the second fiber 316, such a configuration is merely provided for illustrative purposes. The present disclosure may be configured to include various lengths of the first fiber 302 and the second fiber 316 depending on an installation location of the anti-cant rifle/bow indication apparatus 300 on the rifle/bow 602 or the rifle/bow scope 604.

It is contemplated that, while a routing of the first fiber 302 and the second fiber 316 shown in FIG. 6 is selected so as to minimize bending of both the first fiber 302 and the second fiber 316, such a routing configuration is merely provided for illustrative purposes. The present disclosure may be configured to adapt other routings of the first fiber 302 and the second fiber 316.

It is noted that the size of the anti-cant rifle/bow indication apparatus 300 shown in FIG. 6 is merely provided for illustrative purposes and is not a limitation of the present disclosure. It is further noted that the anti-cant rifle/bow indication apparatus 300 may be incorporated into other optics including, but not limited to, telescopes or microscopes.

Figure 7:
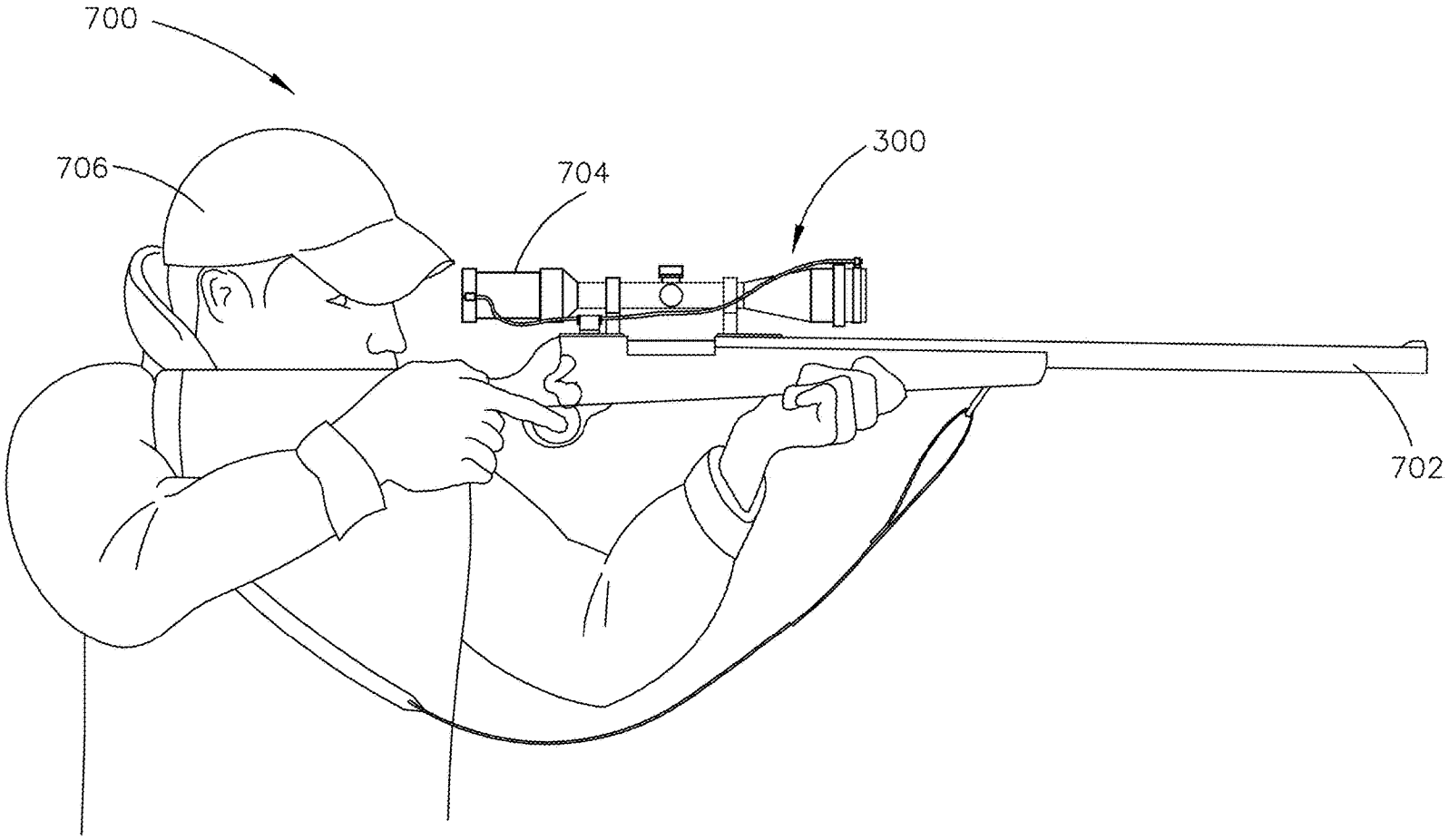
FIG. 7 illustrates a shooting position with a rifle/bow equipped with the anti-cant rifle/bow indication apparatus, in accordance with one or more embodiments of the present disclosure.

FIG. 7 illustrates a shooting position with a rifle/bow equipped with the anti-cant rifle/bow indication apparatus 300, in accordance with one or more embodiments of the present disclosure. It is noted herein that the embodiments and components described previously herein with respect to the apparatus 300 should be interpreted to extend to the embodiments described in FIG. 7.

In one embodiment, a rifle/bow shooting position 700 may include a rifle/bow 702. In some embodiments, the rifle/bow shooting position 700 may include a rifle/bow scope 704 mounted on the rifle/bow 702. In some embodiments, the rifle/bow shooting position 700 may include the anti-cant rifle/bow indication apparatus 300 installed on a top flat surface of a mounting rail of the rifle/bow 702. The indicator end 316*a* of the anti-cant rifle/bow indication apparatus 300 is attached on the eyepiece of the rifle/bow 702. In some embodiments, the rifle/bow shooting position 700 may include a shooter 706 holding the rifle/bow assembly (i.e., a rifle/bow 702, a rifle/bow scope 704, and the anti-cant rifle/bow indication apparatus 300).

It is noted that the shooter looking at the rifle/bow scope 704 is able to see the light shining from the indicator end 316*a* of the anti-cant rifle/bow indication apparatus 300 with great ease when the rifle/bow 702 experiences no canting. It is further noted that in order for the shooter to use the anti-cant rifle/bow indication apparatus 300 effectively, no special shooting position is required.

Figure 8:
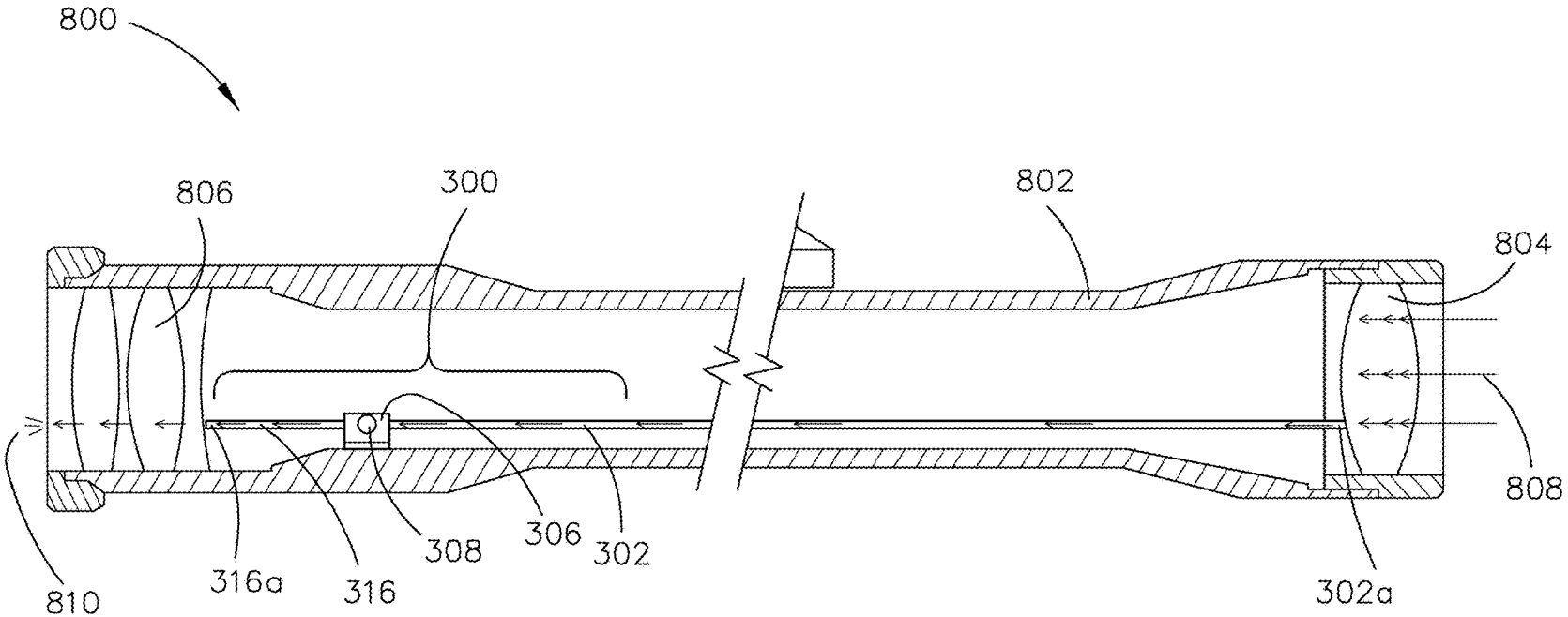
FIG. 8 illustrates a simplified rifle/bow scope internal structure incorporated with the anti-cant rifle/bow indication apparatus, in accordance with one or more embodiments of the present disclosure.

FIG. 8 illustrates a simplified rifle/bow scope internal structure incorporated with the anti-cant rifle/bow indication apparatus 300, in accordance with one or more embodiments of the present disclosure. It is noted herein that the embodiments and components described previously herein with respect to the apparatus 300 should be interpreted to extend to the embodiments described in FIG. 8.

In one embodiment, the rifle/bow scope internal structure 800 may include a scope tube 802 enclosing various optical components inside the rifle/bow scope. In some embodiments, the rifle/bow scope internal structure 800 may include an objective lens assembly 804 for collecting light to form an image. In some embodiments, the rifle/bow scope internal structure 800 may include an ocular lens assembly 806 (i.e., eyepiece) for magnifying the image.

In some embodiments, the rifle/bow scope internal structure 800 may include the anti-cant rifle/bow indication apparatus 300 inside the scope tube 802. For example, the light collecting end 302*a* of the first fiber 302 of the anti-cant rifle/bow indication apparatus 300 may be positioned close to the objective lens assembly 804 so as to collect light 808 effectively. In some embodiments, the spirit level vial 306 of the anti-cant rifle/bow indication apparatus 300 may be placed on a flat surface of the internal rifle/bow scope. For example, the spirit level vial 306 of the anti-cant rifle/bow indication apparatus 300 may be placed perpendicular to the rifle/bow scope in order to correctly detect canting of the rifle/bow scope. In some embodiments, the indicator end 316*a* of the second fiber 316 of the anti-cant rifle/bow indication apparatus 300 may be positioned close to the ocular lens assembly 806 so as to send the indicator light 810 to the eyepiece of the rifle/bow scope.

It is contemplated that, while the spirit level vial 306 of the anti-cant rifle/bow indication apparatus 300 shown in FIG. 8 is placed closer to the ocular lens assembly 806, such a configuration is merely provided for illustrative purposes. The present disclosure may be configured to adapt other level installation sites including, but not limited to, a site closer to the objective lens assembly 804, or a site in between the objective lens assembly 804 and the ocular lens assembly 806.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. A cant indication apparatus comprising:

a. a spirit level having a first and second surface, said spirit level containing a first fluid, said first fluid having at least one of a first light transmittance and absorbance, and a second fluid forming a bubble in said first fluid, said second fluid having at least one of a second light transmittance and absorbance, said bubble position indicating orientation;

b. a light receiving optical fiber having a light receiving end and a spirit level connection end, said optical fiber spirit level connection end connected to said first surface of said spirit level whereupon said spirit level bubble is nearest said spirit level connection end of said light receiving optical fiber when said spirit level is in an uncanted orientation; and c. a light transmitting and cant indicating optical fiber having a spirit level connection end and an orientation indication end, said optical fiber spirit level connection end connected to said second surface so as to be in substantial optical alignment with said optical fiber spirit level connection of said light receiving optical fiber, said orientation end illumination indicating at least one of a canted orientation and said uncanted orientation.

* * * * *